United States Patent [19]

Tucker et al.

[11] Patent Number: 4,993,600

[45] Date of Patent: Feb. 19, 1991

[54] LIQUID DISPENSER PUMP

[75] Inventors: Council A. Tucker, Mebane, N.C.; Jimmie L. Whittington, Diamond Bar, Calif.

[73] Assignee: James River Corporation, Oakland, Calif.

[21] Appl. No.: 419,334

[22] Filed: Oct. 10, 1989

[51] Int. Cl.[5] ..... B65D 88/54

[52] U.S. Cl. ..... 222/321; 222/181; 222/341; 222/378; 222/501; 222/514

[58] Field of Search ..... 222/181, 185, 341, 321, 222/385, 378, 514, 501

[56] References Cited

U.S. PATENT DOCUMENTS 3,321,111 5/1967 Jellinek ..... 222/321

FOREIGN PATENT DOCUMENTS 312424 4/1989 European Pat. Off. ..... 222/341

1064626 5/1954 France ..... 222/383

*Primary Examiner*—Michael S. Huppert

*Assistant Examiner*—Gregory L. Huson

*Attorney, Agent, or Firm*—Thomas R. Lampe

[57] ABSTRACT

A liquid dispenser pump including a pump housing, a piston movable within the pump housing, a seal including a resilient wall disposed about the piston, and a reinforcement member for urging the resilient seal wall outwardly into fluid-tight engagement with the pump housing.

6 Claims, 3 Drawing Sheets

LIQUID DISPENSER PUMP

TECHNICAL FIELD

This invention relates to a pump adapted for attachment to a container and for delivering liquid, such as liquid soap, from the interior of the container.

BACKGROUND ART

A great many types of liquid dispenser pumps are known in the prior art. Some of these pump arrangements have been designed specifically for use in dispensing liquid soaps and the like. The dispenser pumps may be actuated directly by hand or through a suitable intermediate mechanism. Soap dispensers employed for institutional use have commonly been wall mounted and incorporate cabinets with refillable reservoirs used to supply the pump mechanism which routinely is part of the cabinet.

A relatively more recent development has been to employ wall mounted cabinets which are essentially holders for a disposable bottle or other container having all or part of a pump mechanism fixedly attached thereto. When empty, the container and that portion of the pump affixed thereto are discarded.

Throw-away, non-refillable container and pump combinations are particularly appropriate and useful to prevent contamination of the soap or other liquid to be dispensed and to insure that the liquid being dispensed is of a particular type and character. For example, hospitals and other health care facilities often wish to make certain that a disinfectant-type of soap is always being dispensed from a dispenser. If the dispenser were refillable this would not necessarily be the case. Also, of course, there is always the possibility of contamination if refilling is permitted. Hospitals and other health care facilities are in fact increasingly requiring the use of bags or other collapsible containers having affixed thereto a disposable pump mechanism which does not allow the intrusion of ambient air during the dispensing process.

It will be appreciated that a disposable pump must be inexpensive as well as suitable for its intended purpose. Materials costs are of course a factor as are simplicity of pump design and ease of assembly. Many of the existing disposable pump constructions are characterized by their relatively high cost and complexity and it is an object of the present invention to provide a pump for liquid soap and the like which is simple, reliable in operation, and inexpensive in construction.

BRIEF SUMMARY OF THE INVENTION

The present invention relates to a liquid dispenser pump including cap means for attaching the pump to a container. The cap means includes a peripheral wall at least partially defining a pump housing interior in fluid-flow communication with the container interior when the cap means is attached to the container. The cap means defines an aperture leading to the pump housing interior.

Piston means projects through the aperture into the pump housing interior and is displaceable between a first position and a second position, the piston means defining a passageway extending therethrough between a piston inlet opening located within the pump housing and a piston outlet opening located exteriorly thereof.

Seal means is disposed about the piston means and includes a resilient seal wall. The seal means is moveable with the piston means and slidable along the cap means peripheral wall when the piston means moves between the first and second positions. Reinforcement means is provided for urging the resilient seal wall into substantially fluid-type engagement with the peripheral wall.

Valve means is operatively associated with the piston means and responsive to movement of the piston means to dispense liquid through the passageway and out of the outlet opening when the piston means moves from the first position to the second position.

In the illustrated preferred embodiment of the invention a feature of particular importance is the above-recited seal means—reinforcement means combination which contributes to the reliability and low cost of the dispenser pump.

Other features, advantages, and objects of the present invention will become apparent with reference to the following detailed description and accompanying drawings.

BEST MODE FOR CARRYING OUT THE INVENTION

Figure 3:
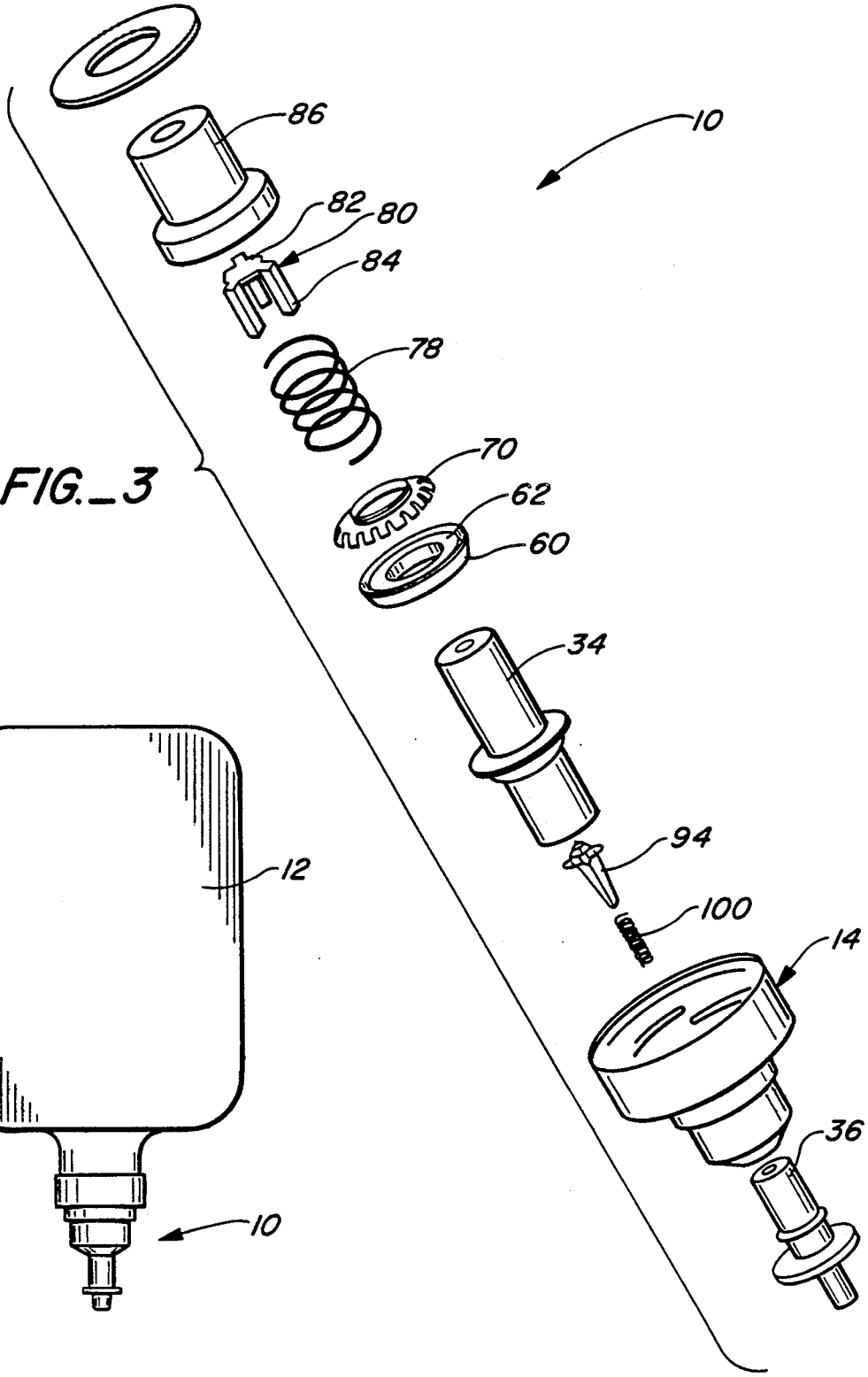
FIG. 3 is an exploded perspective view illustrating the components of the pump.
Figure 1:
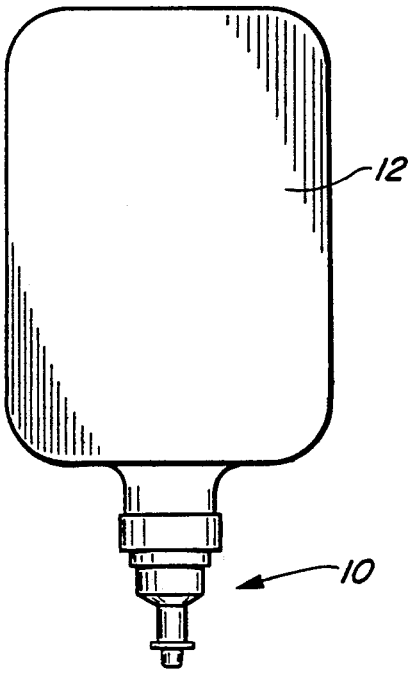
FIG. 1 is an elevation view illustrating a pump constructed in accordance with the teachings of the present invention attached to a container.

Referring now to the drawings, a preferred embodiment of a liquid dispenser pump constructed in accordance with the teachings of the present invention is illustrated and designated generally by the reference numeral 10. The pump 10, as is illustrated in FIG. 1, is adapted for use with a container or bottle 12 and for the purpose of dispensing the liquid contents of the container when the container is inverted.

For example, one liquid which may be dispensed by pump 10 is liquid soap. The pump 10 is particularly useful, because of its relative simplicity and inexpensive construction, as a throw-away item attached to a dispenser bottle discarded upon depletion of the contents thereof.

The liquid dispenser pump 10 includes cap means 14 for attaching the pump to container 10 as by means of screw threads 16 which cooperate with mating screw threads (not shown) on the neck of the container 12 as is conventional. In order to prevent refill of the container 12, the pump 10 is fixedly attached thereto as, for example, by virtue of heat sealing or the employment of adhesives.

The present pump is adapted for use with a collapsible container since, as will be seen below, a vacuum is formed in the interior of the container when liquid is dispensed therefrom. Co-pending U.S. application Ser. No. 07/573,472, filed 08/27/90 discloses a container in the form of a plastic bottle which will gradually collapse during dispensing and tend to retain a collapsed shape due to cold-flow experienced progressively during the period of bottle collapse. Use of such a plastic bottle in conjunction with the present pump fixedly secured thereto will further deter against container refill and reuse.

Screw threads 16 are formed on the interior surface of a first portion 18 of peripheral wall 20. Peripheral wall 20 also includes a second portion 22 having an outer diameter less than the outer diameter of the first portion 18 and a third peripheral wall portion 24 having an outer diameter less than the outer diameter of second portion 22. Extending from the lower end of third peripheral wall portion 24 is a funnel-like inclined wall 26 defining an aperture 28. Aperture 28, which is of circular cross section, communicates with the interior 30 defined by peripheral wall 20 and hereinafter designated as the pump housing interior. Pump housing interior 30 is in fluid-flow communication with the interior of container 12 when the cap means is attached to the container.

Piston means 32 including a first piston segment 34 and a second piston segment 36 projects through aperture 28 into the pump housing interior.

First piston segment 34 includes an elongated tubular body 38 having a terminal wall 40 at the upper end thereof in which is formed a piston inlet opening 42. A flange 44 is integrally formed with elongated tubular body 38 and projects therefrom. Flange 44 includes a flat upper surface 46 and a lower inclined surface 48 which converge as illustrated. The outermost dimension of the flange 44 generally corresponds to the dimension of the interior surface of peripheral wall third portion 24 and the lower inclined surface 48 of the flange 44 has an angle of inclination corresponding to that of inclined wall 26 whereby the flange 44 and the inclined wall 26 are in mating engagement when the components of the pump 10 are in the relative positions illustrated in FIG. 2.

Second piston segment 36 is also of generally tubular construction with the upper end thereof positioned in elongated tubular body 38 of the first piston segment 34 as shown. A radially extending notch 50 is formed in the interior wall of elongated tubular body 38 and is adapted to retain therein a detent 52 comprising a portion of the second piston segment 36. Once positioned in notch 50 the detent is fixedly retained therein.

Second piston segment 36 also includes a projection 54 disposed below detent 52, said projection engaging the lower end of the elongated tubular body 38 when the detent 52 is snapped into position in notch 50. Projection 54 is larger than aperture 28 and the piston means 32 is assembled by first passing the lower end of elongated tubular body 38 downwardly through aperture 28 and then inserting the second piston segment 36 into first piston segment 34 until the detent 52 snaps into notch 50.

It will be appreciated that the first and second piston segments 34, 36 are assembled in fluid-tight relationship and that securement therebetween is intended to be permanent. First and second piston segments 34, 36 cooperate to define a passageway 56 extending therethrough between piston inlet opening 42 located within the pump housing interior 30 and a piston outlet opening 58 located exteriorly thereof.

Figure 2A:
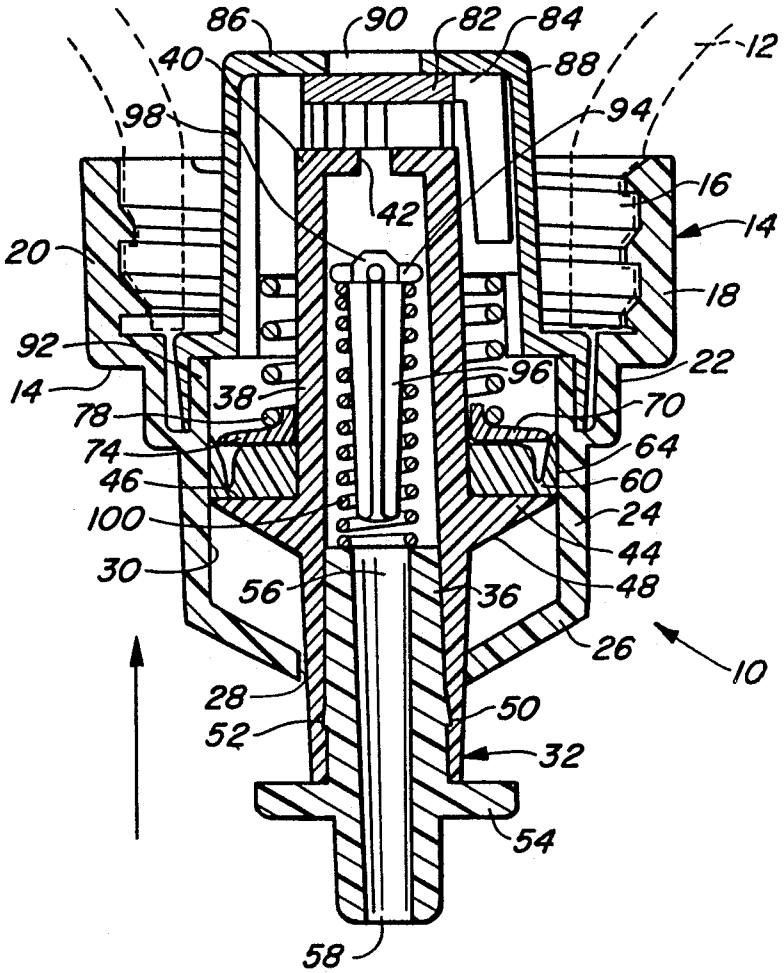
FIG. 2A is a view similar to FIG. 2 but illustrating the components of the pump in the positions assumed thereby when the piston means is in a second position.
Figure 2:
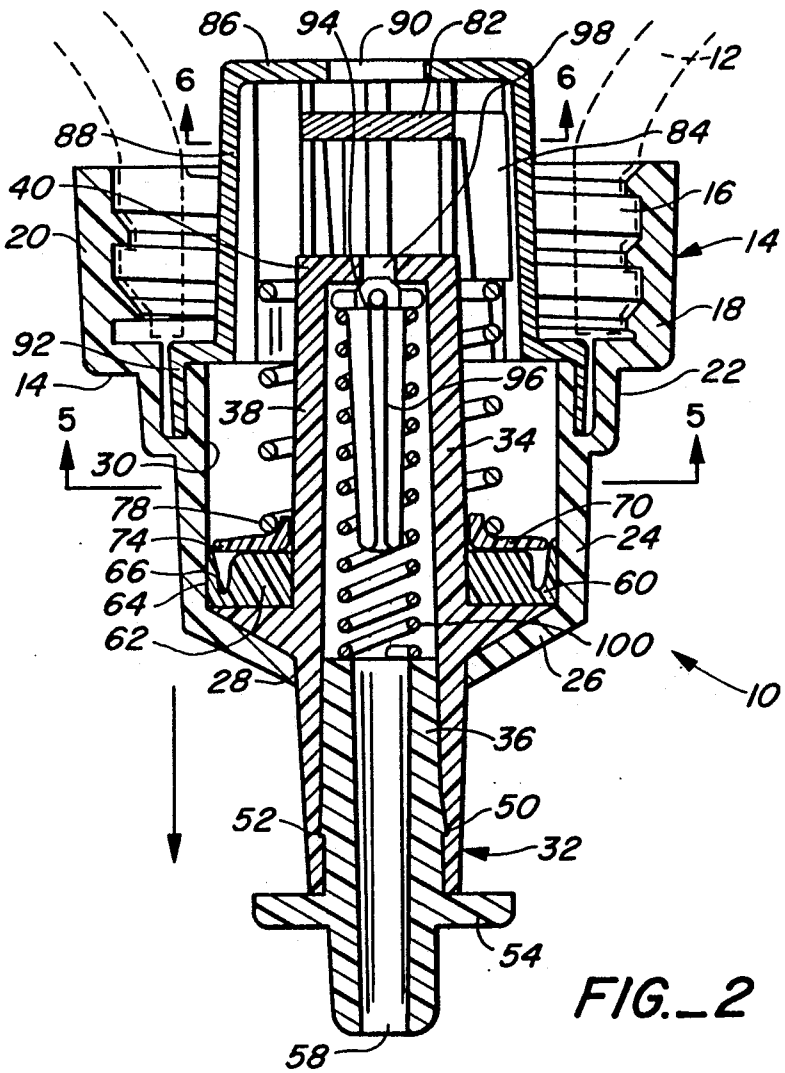
FIG. 2 is a cross-sectional elevation view of the pump with the components thereof in the positions assumed thereby when the pump piston means is in a first position.

Seal means 60 is disposed about the piston means 32, said seal means being moveable with the piston means and slidable along the interior surface of peripheral wall portion 24 when the piston means moves between the first position illustrated in FIG. 2 and the second position illustrated in FIG. 2A.

Seal means 60 comprises a cup seal including a generally donut-shaped seal body 62 and a resilient seal wall 64 connected to the seal body 62 at a reduced, radially extending area of thickness 66. Thus, the wall 64 has a distal end spaced from seal body 62, the distal end extending upwardly to a location beyond the upper plane of the seal body 62.

The seal means 60 must be constructed of relatively soft material to make a good seal by conforming to the inner surface of the peripheral wall portion 24. A suitable material for the seal means is low density polyethylene. The problem, however, is that low density polyethylene and similar types of soft plastic materials do not have sufficient structural strength to maintain continuous contact with the peripheral wall.

Reinforcement means comprising a reinforcement member 70 is in engagement with the seal wall distal end and resists displacement of the seal wall distal end away from the peripheral wall portion 24. Reinforcement member 70 is formed of a relatively stiff material and is preferably of unitary, molded polypropylene construction.

Reinforcement member 70 comprises an apertured core element 72 disposed about the piston member and in at least partial registry with the seal body 62. A plurality of discrete contact fingers 74 radiate outwardly from the core element and have free ends in engagement with the seal wall distal end at spaced locations thereon. The reinforcement member 70 has a generally circular configuration and the contact finger free ends and the core element are relatively displaceable to increase the pressure exerted thereby against the seal wall.

Figure 4:
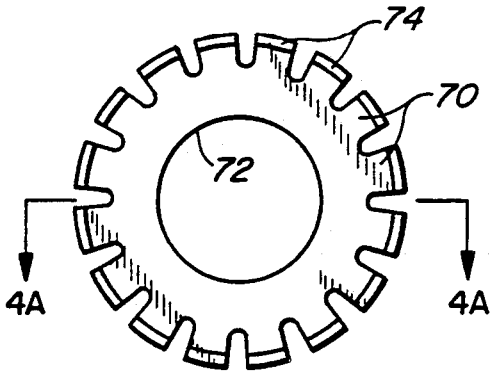
FIG. 4 is a plan view of the pump reinforcement means.
Figure 4A:
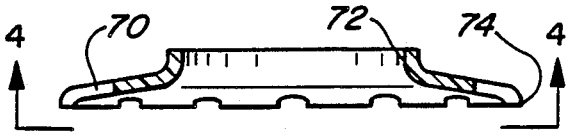
FIG. 4A is a cross-sectional view taken along line 4A—4A in FIG. 4.
Figure 5:
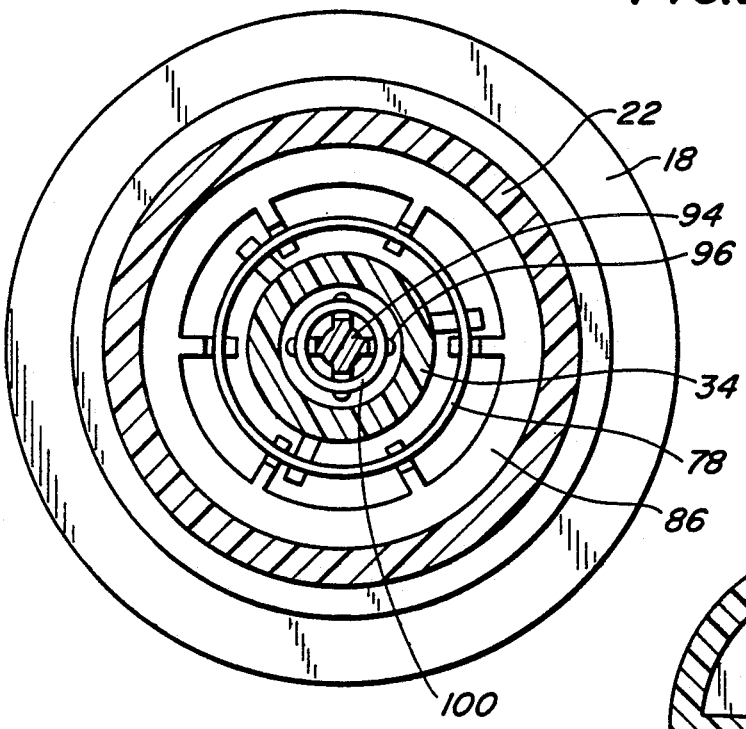
FIG. 5 is a cross-sectional view taken along the line 5—5 in FIG. 2.
Figure 6:
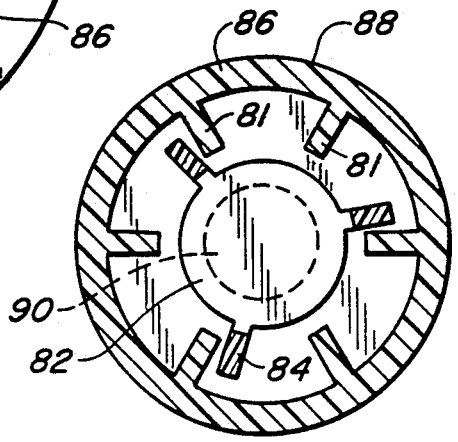
FIG. 6 is a cross-sectional view of the pump taken along line 6—6 in FIG. 2.

The increase in pressure is accomplished by causing relative displacement between the contact finger free ends and the core element by deforming the reinforcement member from the position normally assumed thereby when in essentially unstressed condition. In such unstressed condition, the reinforcement member 70 has the cross-sectional profile illustrated in FIGS. 4A; that is, the reinforcement member 70 has a generally cup-like configuration and the contact fingers 74 extend generally downwardly at an incline so that the free ends thereof are disposed in a lower plane than that occupied by core element 72. When, however, a downward pressure is exerted at or near the core element 72, the core element will be pushed downwardly so that the lower-most extent of the core element lies generally in the plane or the contact finger ends. This will exert an increased pressure upon the seal wall distal end and force same into a more positive contact with the inner surface of peripheral wall 20.

The means for providing relative displacement between the contact finger free ends and the core element includes a coil compression spring 78 bearing against the reinforcement member 70 at the core element thereof. Upon pump assembly, the spring 78 is under compressive loading and the spring deforms the reinforcement member as shown in FIGS. 2 and 2A and as described above. Positioned upon coil compression spring 78 is framework 80 comprising a portion of the valve system employed in the pump. Framework 80 includes a valve plate 82 and a plurality of downwardly depending legs 84. The coil compression spring 78 is disposed under legs 84 and in engagement therewith.

The framework 80 is loosely disposed within a cover 86. The cover includes a main cover portion 88 having a hole 90 formed therein and a depending skirt portion 92 which is disposed over and in frictional engagement with an extension of third peripheral wall portion 24 spaced inwardly from second peripheral wall portion 22. When the cap means 14 is screwed into position on the neck of container 12, the container neck engages the skirt portion 92 to retain the cover in position on cap means 14. In FIG. 2 the neck of a bottle 12 is illustrated in phantom lines.

Cover ribs 81 project inwardly from the main cover portion 88 and terminate at the lower extent thereof above skirt portion 92. Ribs 81 contact coil compression spring 78 and prevent upward movement thereof. Ribs 81 are so spaced and positioned as to provide for the loose fit of framework legs 84 therebetween.

An elongated valve element 94 is positioned within passageway 56 within the confines of first piston segment 34 and above second piston segment 36. Valve element 94 has a generally cruciform cross section over most of the length thereof, comprising four elongated ribs 96 attached to an enlarged valve head 98. Valve head 98 is tapered at the top thereof whereby it may seat within piston inlet opening 42 and form a substantially fluid-tight seal therewith.

Valve element 94 is continuously urged in an upward direction by a coil compression spring 100 seated upon second piston segment 36 and in engagement with the bottom of valve head 98. The valve element 94 is normally disposed in the position illustrated in FIG. 2 with the spring 100 urging valve head 98 into engagement with terminal wall 40 and the valve head closing piston inlet opening 42.

When the pump 10 components are in their respective positions illustrated in FIG. 2, liquid soap cannot enter passageway 56 through piston inlet opening 42. However, liquid soap is free to enter hole 90 and occupy that portion of pump housing 30 disposed above seal means 60 and surrounding first piston segment 34. Also, of course, the liquid soap will be disposed within the confines of cover 86.

When an upward force is exerted upon piston means 32, as, for example, by dispenser cabinet mechanism engaging projection 54, the liquid will back-flow through hole 90 and carry framework 80 upwardly until valve plate 82 blocks hole 90. Continued movement of piston means 32 will cause downward displacement of valve element 94 against the urging of spring 100 so that piston inlet opening 42 is opened and the soap may enter passageway 56. The liquid soap will pass downwardly through the passageway and out piston outlet opening 58.

Importantly, upward movement of piston means 32 will cause coil compression spring 78 to exert increased pressure on reinforcement member 70 at the core element 72 thereof. If for some reason the reinforcement member is not fully deformed by the pre-loaded spring when the pump components are in the respective positions shown in FIG. 2, complete deformation will occur when there is added compressive loading of the spring as the components move to their FIG. 2A positions to exert increasing pressure against the seal wall 64.

We claim:

1. A liquid dispenser pump adapted for attachment to a container and for delivering liquid from the interior of said container, said pump comprising, in combination:

cap means for attaching said pump to said container, said cap means including a peripheral wall at least partially defining a pump housing interior in fluid-flow communication with the container interior when said cap means is attached to said container, said cap means defining an aperture leading to said pump housing interior;

piston means projecting through said aperture into said pump housing interior and displaceable between a first position and a second position, said piston means defining a passageway extending therethrough between a piston inlet opening located within said pump housing interior and a piston outlet opening located exteriorly thereof;

seal means disposed about said piston means and including a resilient seal wall, said seal means being movable with said piston means and slidable along said peripheral wall when said piston means moves between said first and second positions, said seal means comprising a cup seal including a seal body in substantially fluid-tight communication with said piston means and disposed between said piston means and said resilient seal wall, said resilient seal wall including a distal end spaced from said seal body and having an outer surface in engagement with said peripheral wall;

reinforcement means for urging said resilient seal wall into substantially fluid-tight engagement with said peripheral wall, said reinforcement means comprising a reinforcement member in engagement with said seal wall distal end and resisting displacement of said seal wall distal end away from said peripheral wall, and said reinforcement member comprising an apertured core element disposed about said piston means in at least partial registry with said seal body and a plurality of discrete contact fingers radiating outwardly from said core element and having free ends in engagement with said seal wall distal end at spaced locations thereon; and valve means operatively associated with said piston means and responsive to movement of said piston means to dispense liquid through said passageway and out said outlet opening when said piston means moves from said first position to said second position.

2. The liquid dispenser pump according to claim 1 wherein said reinforcement member is of unitary, molded polypropylene construction.

3. The liquid dispenser pump according to claim 2 wherein said resilient seal wall is formed of low density polyethylene.

4. The liquid dispenser pump according to claim 1 wherein said reinforcement member has a generally circular configuration and wherein said contact finger free ends are displaceable relative to said core element to increase the pressure exerted thereby against said seal wall.

5. The liquid dispenser pump according to claim 4 additionally including means for providing relative displacement between said contact finger free ends and said core element by deforming said reinforcement member.

6. The liquid dispenser pump according to claim 5 wherein said means for providing relative displacement between said contact finger free ends and said core element includes a spring engaging said reinforcement member, said spring adapted to exert increased compressive forces against said reinforcement member when said piston means moves from said first position to said second position.

* * * * *